US005782325A

United States Patent [19]

O'Shea et al.

[11] Patent Number: 5,782,325

[45] Date of Patent: Jul. 21, 1998

[54] EXTENDABLE-HANDLE ROLLING SUITCASE

[75] Inventors: James O'Shea, Annandale, N.J.; Jay Evan Myers, Newport Beach, Calif.

[73] Assignees: Andiamo, Inc., Fountain Valley, Calif.; Royalox International, Inc., Phillipsburg, N.J.

[21] Appl. No.: 773,636

[22] Filed: Dec. 24, 1996

[51] Int. Cl.[6] ..... A45C 5/14; A45C 13/26; A45C 13/36

[52] U.S. Cl. ..... 190/18 A; 190/39; 190/115; 190/127; 16/115

[58] Field of Search ..... 190/18 A, 115, 190/127; 16/115

[56] References Cited

U.S. PATENT DOCUMENTS

| | | | |
|---|---|---|---|
| 4,762,211 | 8/1988 | Krenzel | 190/127 X |
| 5,115,895 | 5/1992 | Myers | 190/127 X |
| 5,431,428 | 7/1995 | Marchwiak et al. | 190/18 A X |
| 5,433,461 | 7/1995 | Chang | 190/18 A X |
| 5,482,147 | 1/1996 | Wang | 190/18 A |
| 5,498,010 | 3/1996 | Stube | 190/18 A X |
| 5,502,876 | 4/1996 | Wang | 16/115 |
| 5,513,873 | 5/1996 | Chen | 16/115 X |
| 5,524,920 | 6/1996 | Tsai | 190/18 A X |
| 5,533,601 | 7/1996 | Wang | 190/115 |
| 5,639,109 | 6/1997 | Liang | 190/18 A X |

*Primary Examiner*—Sue A. Weaver
*Attorney, Agent, or Firm*—Herbert Dubno; Yuri Kateshov

[57] ABSTRACT

A rolling suitcase has a bottom assembly to which the wheel wells are connected which can be molded in one size and cut to suit various case widths. A pullout handle assembly is braced against the internal frame of the case to prevent rotation of that assembly and utilizes a rotating lever mechanism for minimum friction.

11 Claims, 10 Drawing Sheets

EXTENDABLE-HANDLE ROLLING SUITCASE

FIELD OF THE INVENTION

Our present invention relates to an extendable-handle rolling suitcase which may be manufactured in various sizes, including a size enabling the suitcase to be stored in an overhead compartment of an aircraft. More particularly, the invention relates to improvements in the handle mechanism, the support structure and other characteristics of such an article of rolling luggage.

BACKGROUND OF THE INVENTION

Compact luggage provided with wheels and a pull-out handle is widely used by travelers for convenience. Such luggage can comprise a case generally composed of a soft material on a frame which may have wheel housings attached to a bottom of the frame and a handle mechanism from which a pair of handle shanks can be extended upwardly upon release of a locking mechanism. The shanks are connected by a handle which, when extended, enables the suitcase to be drawn along the ground on its wheels. When the handle is retracted to lie in a recess at the top of the article, the latter can be readily received in an overhead compartment of an aircraft or even, if of proper size, placed under the seat.

A variety of wheel housing structures and handle mechanisms are utilized in prior art systems. Generally the wheel housing structure includes inner and outer molded members which are connected together. With earlier designs of such housings, which sandwich the material of the case between them and may be connected to the internal support frame over which the case material is extended, there is a tendency of the frame to bow and the wheel housings to twist with respect to one another. Assembly of the wheel housing to the frame and the fabric of the case is complex and labor-intensive. While some of these problems may be avoided with a one-piece housing structure, such a one-piece construction has limited versatility and requires a separately molded part for each different size of the case.

With respect to the handle mechanisms which have been developed heretofore, in general these utilize a camming action which involves a high degree of friction and hence undue wear of the parts and the need for application of considerable force to release the lock.

Finally, mention may be made of the structure within the case in which the shanks of the handle are displaceable. In the past, a tubular housing has been provided either as part of a complex frame or support structure or as a support tube anchored in a complex way to support bodies at the top and bottom of the case. These systems likewise require labor-intensive assembly operations.

OBJECTS OF THE INVENTION

It is, therefore, the principal object of our present invention to provide a pull-out-handle rolling case, especially a suitcase capable of being utilized as carry-on luggage and to be received in an overhead compartment of an aircraft, whereby the aforementioned drawbacks are avoided.

Another object of this invention is to provide a rolling suitcase of the type described which precludes bowing of the bottom, can be assembled more efficiently and utilizes more versatile parts readily adaptable for sizing to different case dimensions.

Yet another object of this invention is to provide an improved handle structure for such a case whereby operating friction and wear can be significantly reduced.

Still a further object of the invention is to provide an improved extendable-handle suitcase which is free from drawbacks of earlier systems and requires less labor to assemble than earlier cases.

SUMMARY OF THE INVENTION

These objects are attained, in accordance with the invention in a rolling case of the type described which comprises an internal frame structure received within the body of the case, which can be constituted of a fabric, and a wheel support at the bottom of the case connected to the frame and comprising an inner member spanned across the entire width of the bottom and connected to a pair of terminal portions formed with the wheel wells. An outer wheel-well member is secured to each of these inner portions through the case body material.

According to a feature of the invention, the support spanning the entire width of the case at the bottom thereof is of L-shaped cross section having a back lying along the rear of the case and a bottom which lies along the bottom of the case adjoining the back at a right angle. The support is provided with means enabling the support to be readily cut through so as to sever ends of the support to enable the support to be shortened and thus accommodated to cases of lesser width. A number of such means can be provided so that one and the same molded support can be accommodated to two or more case widths.

The support is provided with elongated passages through which the terminal portions are bolted to the outer members, thereby enabling adjustment in the width direction to compensate for fabricating tolerances. Between the inner portions and the support, a horizontal rib structure can be provided which limits bowing of the support and hence of the case at the bottom and back thereof and to provide guide means along which the inner portions and the outer members are at least limitedly slidable.

According to an important feature of the invention, the outer members are affixed to the support and inner portions at three mutually perpendicular planes, thereby affording a high degree of stability.

The support itself is formed with elongated vertical slots facilitating adjustment of the support in the height direction relative to any back structure of the case. The support can also be provided with tubular formations receiving the tubes through which the shanks of the handle are guided.

According to another aspect of the invention, the handle structure can comprise a housing mounted within the case at an upper end thereof and forming a recess in which the handle itself can be recessed when the handle assembly is in its retracted position. The handle can bridge a pair of shanks which can be guided within the case in respective tubes bridging the aforementioned housing and the support.

According to a feature of the invention, a locking mechanism is provided within the housing which, instead of having a cam action as is characteristic a number of earlier locking mechanisms, has a pair of swingable levers which can be rotated when a slide on the housing is depressed to withdraw respective pins from the tubular shanks of the lock assembly and enable the same to be withdrawn from the case into the extended position of the handle assembly.

While the use of this lock assembly in conjunction with the aforementioned support and wheel well structure is preferred, it is not essential and the lock assembly can be used with any case having a handle assembly adapted to be received in or withdrawn from the case in inoperative and operative positions respectively.

According to a further feature of the invention, the tubes can be anchored in the housing via respective detents so that upon simple insertion of the tubes into the housing, the detents snap into place and retain the tubes against withdrawal.

Since the usual method of fabricating a rolling luggage case is to connect the ends of a continuous frame member at the bottom of the case, we provide means for attaching these ends to the support which can thus brace the ends against downward bowing of the frame even when the suitcase contains a heavy load.

Since there is a tendency of the housing to twist, when the handle assembly is extended, we have found that it is advantageous to provide braces for the handle assembly which are bent to extend onto the sides of the case and can be secured there against torsion, e.g. by a single rivet and a pair of pins which bite into the frame. These braces can interfit with the housing structure in a tongue-and-groove connection so as to limit the torque effect.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
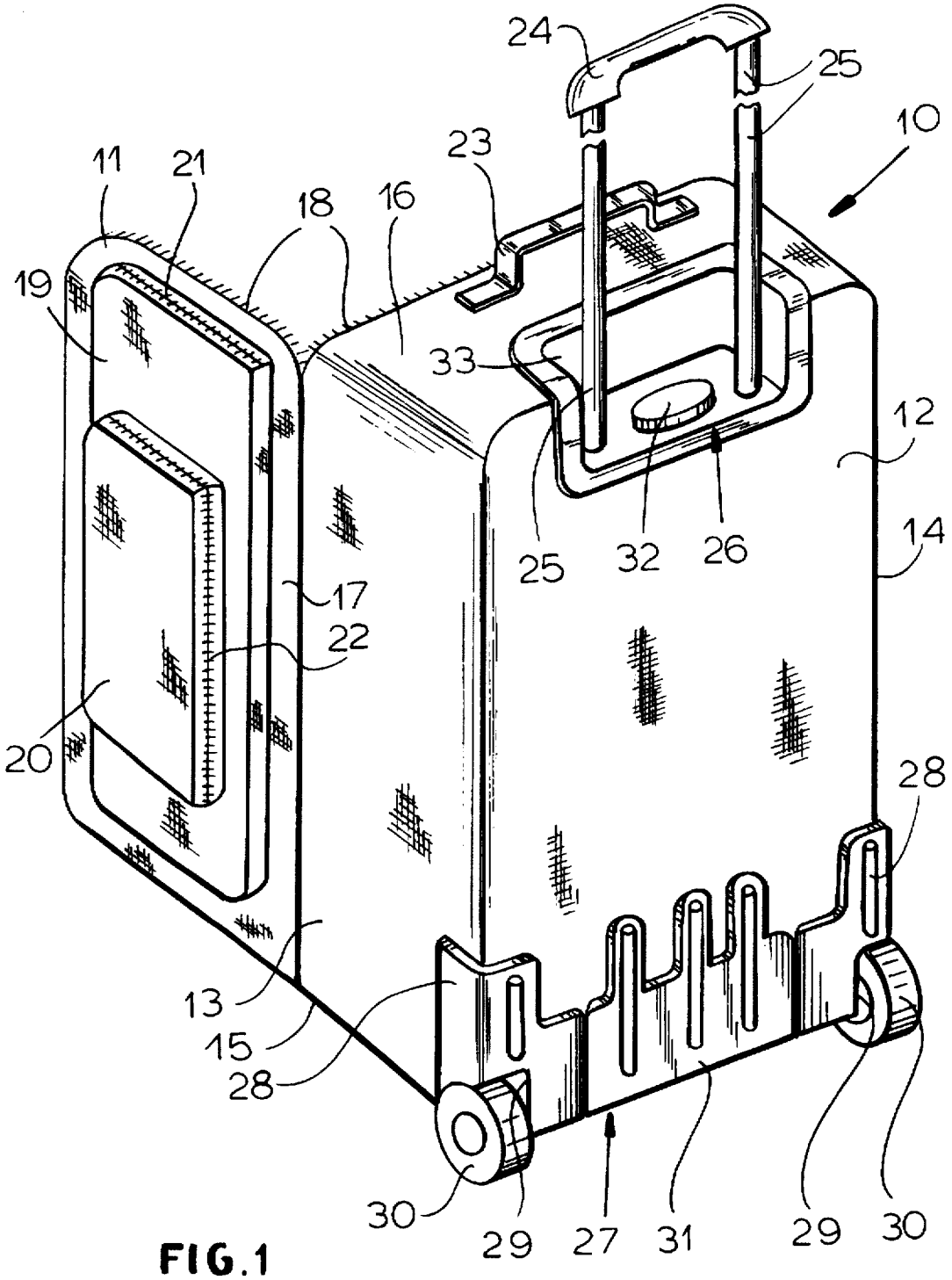
FIG. 1 is a rear perspective view of an extendable-handle rolling suitcase embodying the device of the present invention.

In FIG. 1 of the drawing I have shown a rolling article of luggage, particularly a suitcase 10, from the rear with the front flap 11 open and the outer members of the bottom assembly visible.

Basically, this case comprises a fabric rear wall 12, fabric side walls 13 and 14, a fabric bottom 15, a fabric top wall 16 and a front wall formed by the flap 11 which is held by a flexible hinge portion 17 to the side wall 13 and can be fixed in place by a slide fastener 18 running around the periphery of the flap 11. The latter can have pockets 19 and 20 with slide fastener openings 21 and 22 if desired.

In addition to the usual handle 23 on the top wall 16, this article is provided with a pull-out handle 24 whose shanks 25 are tubes extending through a housing 26 provided with a locking mechanism which will be described in greater detail below.

In addition, along the rear bottom edge, this article is provided with a bottom assembly 27 whose external elements include a pair of corner members 28 having wheel wells 29 in which wheels 30 are journaled. In addition, a central member 31 is provided between the corner members 28.

Within the housig 26 is a lock actuated by the button 32 which releases the handle 24 so that it can be pulled upwardly and locked in place in its extended position until the button 32 is actuated to allow the handle to retract into the article. In the retracted position of the handle, the latter lies within a recess 33 of the housing 26. This rolling suitcase operates in the usual manner. With the flap 11 open, the suitcase can be packed whereupon the flap is closed by the slide fastener 18. When the button 32 is depressed, the handle 24 can be pulled out and the article can be drawn along the floor or the ground on the rollers 30 by the handle.

Figure 2:
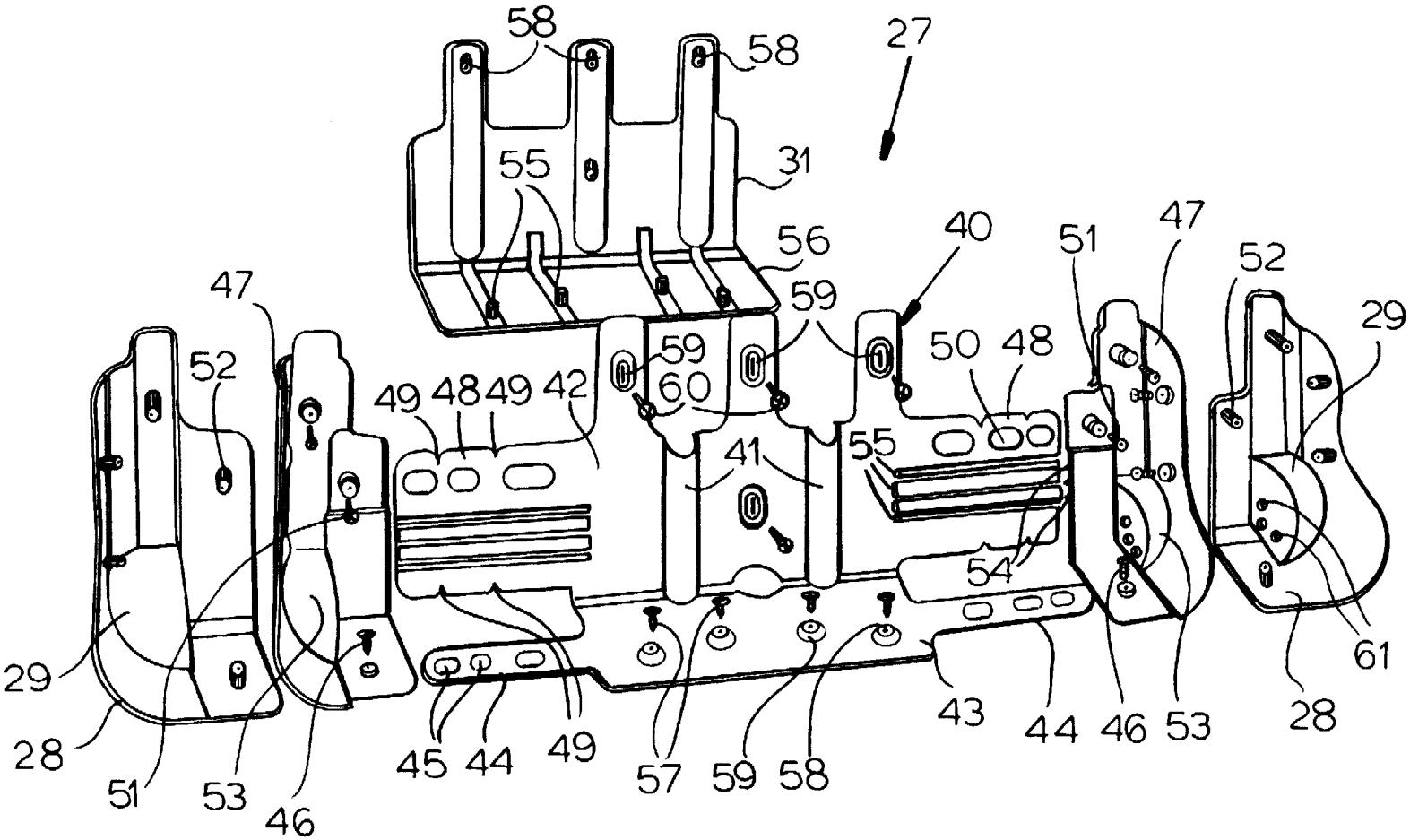
FIG. 2 is an assembly drawing of the bottom assembly for the article.

The bottom assembly 27 has been shown in detail in FIG. 2 and comprises the corners 28 previously mentioned and the central member 31.

Within the case, a member 40 is provided, this member having channels 41 receiving the bottom ends of a pair of cylindrical guide tubes within which the tubes 25 can move. These guide channels 41 which protrude inwardly form a rear wall 42 and reach to the bottom flange 43 of this member. The bottom flange 43 has a pair of extensions 44 provided with holes 45 through which screws 46 can pass in securing the inner corner members 47 to the inner central member 40. Similarly, the rear 42 of member 40 has a pair of wings 48 with notches 49 or other weakenings, allowing the wings 48 to be cut at these notches, thereby foreshortening member 40 to suitcases of narrower width. Excess lengths of the projections 44 can also be cut off in this manner.

The wings 48 are provided with slots 50 traversed by the screws 51 which pass through them to studs 52 on the outer corner members 28. A fabric from the side walls, rear and bottom of the case is located between the outer members 28 and 47 at each corner of the assembly 27. To permit such assembly, the wheel wells 53 of the inner members 47 are dimensioned to receive the wheel wells 29 of the outer members 28. Additional studs are provided on the latter member to accommodate screws extending perpendicularly to each of the three planes forming the respective corner.

The inner members 47, moreover, are provided with ribs 54 which are slideably engage in the slots 55 of the respective wing 48 to braced the members 47 and 48 against one another and prevent canting of the members 47.

The central member 31, previously described, has studs 55 on its bottom flange 56 underlying the flange 43 and engaged by screws 57 which pass through holes 58 in respective bosses 59 of the flange 43, the bottom fabric being interposed between member 31 and member 40. Additional studs at 58 engage in elongated holes 59 of bosses receiving the screws 60, the elongated bosses and slots assuring adjustability of the parts relative to one another upon assembly of the case.

In practice, the members 28, 47 and 30 are identical for all sizes of the cases made while a single injection-molded central unit 40 is used and has its wings 48 and projections 44 cut to suit cases of different widths. The wheel can then be mounted in the wheel wells, utilizing the appropriate bores 61 determining the positions of the wheel axle as may be desired.

Figure 3:
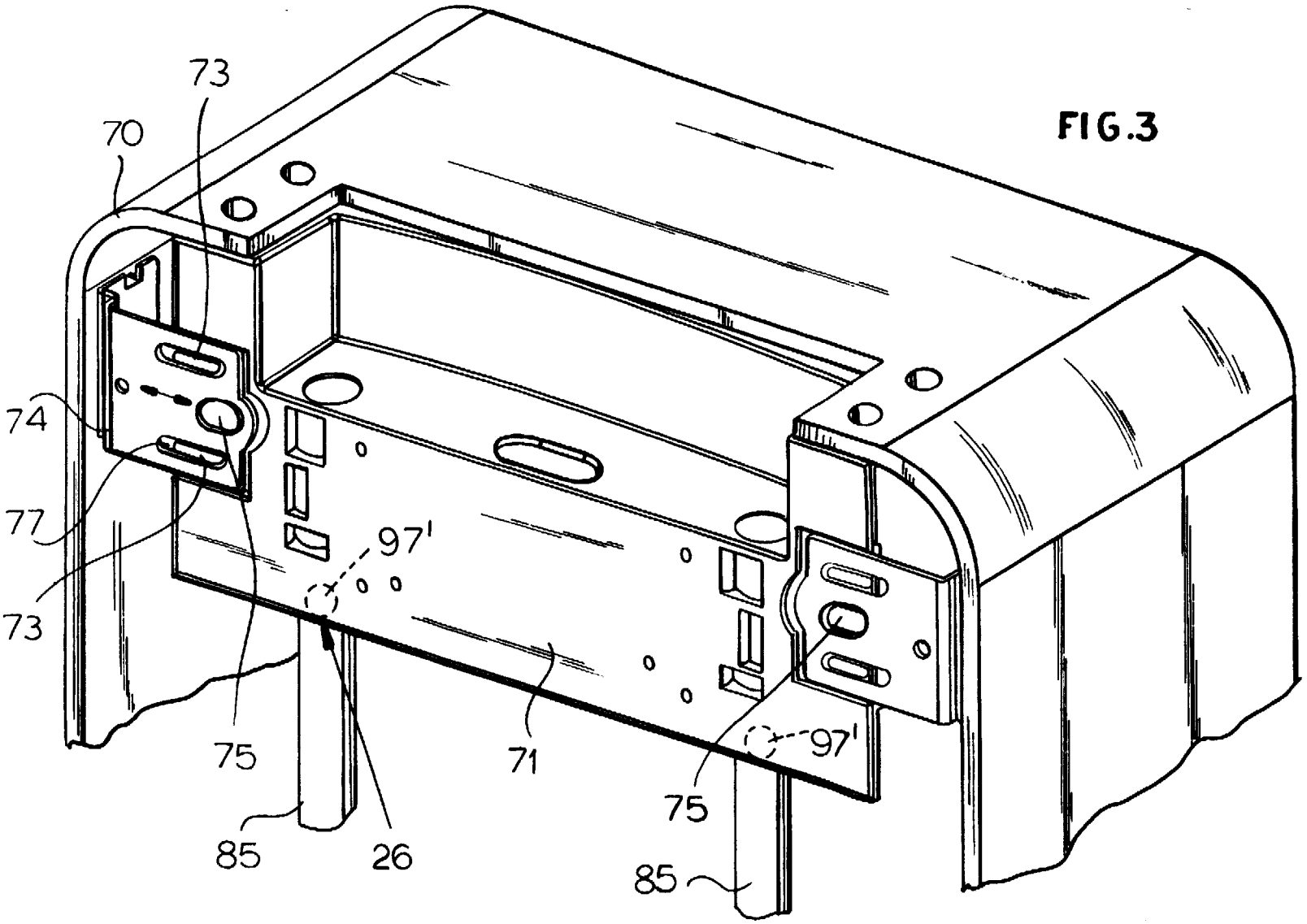
FIG. 3 is a diagram of the relationship between the lock housing of the case frame, also in a perspective view.
Figure 4:
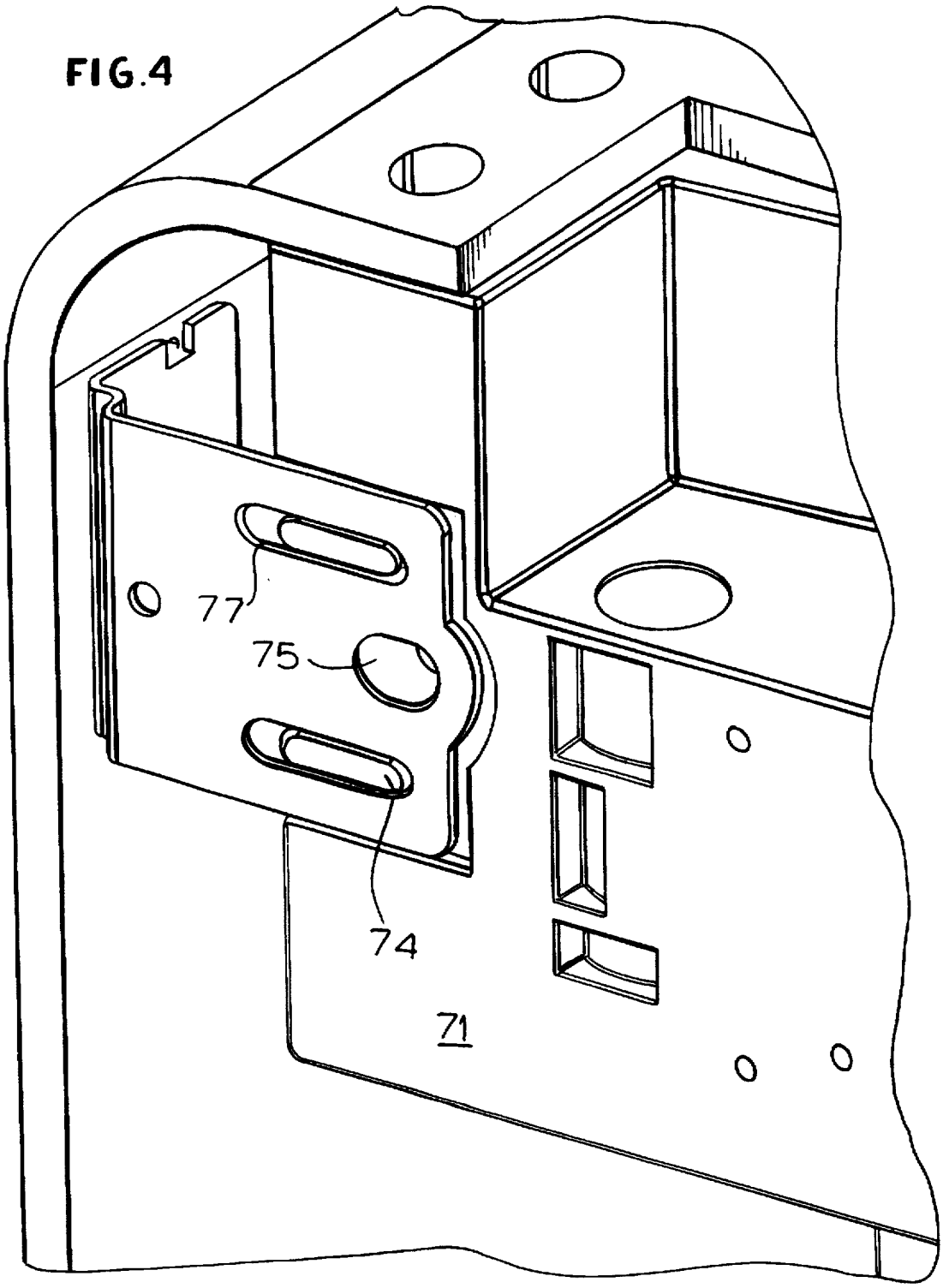
FIG. 4 is a perspective view showing a detail of the anti-rotation device preventing rotation of this housing.

Within the case there is a sheet metal frame represented at 70 in FIG. 3 and, of course, covered with fabric in practice.

The bottom limb of this frame can be received between the outer members 28, 31 and the inner members 47, 40 of the bottom assembly. It has been found to be advantageous to provide the lock assembly 26 at the top of the case with a housing 71 containing the lock mechanism and which cooperates with an outer housing member 72 (FIG. 7) for aesthetic purposes.

The housing 71 can be formed with ribs 73 enabling adjustment of respective brackets 74 on the housing, the brackets being fixed in place by screws passing through slots 75 in the brackets. Each bracket is provided with a pair of teeth 76 (FIG. 7) which engage in openings in the frame 70 to prevent rotation of the housing 71 about a horizontal axis even under the high leverage which results when the handle is extended.

The ribs 73 cooperate with the slots 77 in the brackets in a tongue-and-groove connection to prevent pivoting of the brackets relative to the housing 71. Only a single fastener through the slot 74 is necessary to hold the bracket onto the housing. The brackets, therefore, form braces securing the housing 71 and hence the entire handle mechanism against movement relative to the case frame.

Figure 5:
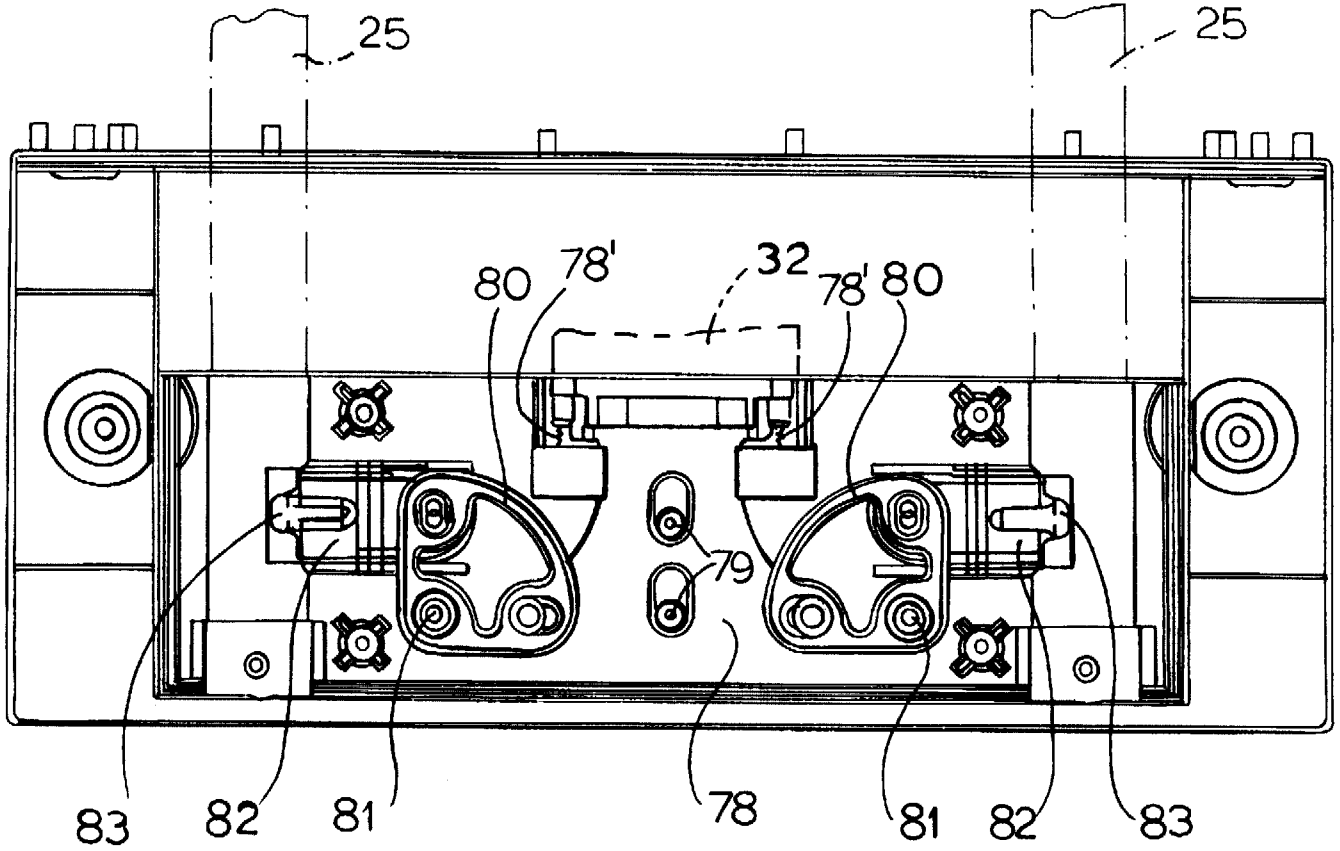
FIG. 5 is a rear view of the lock assembly with a cover plate removed showing the actuating system.
Figure 6:
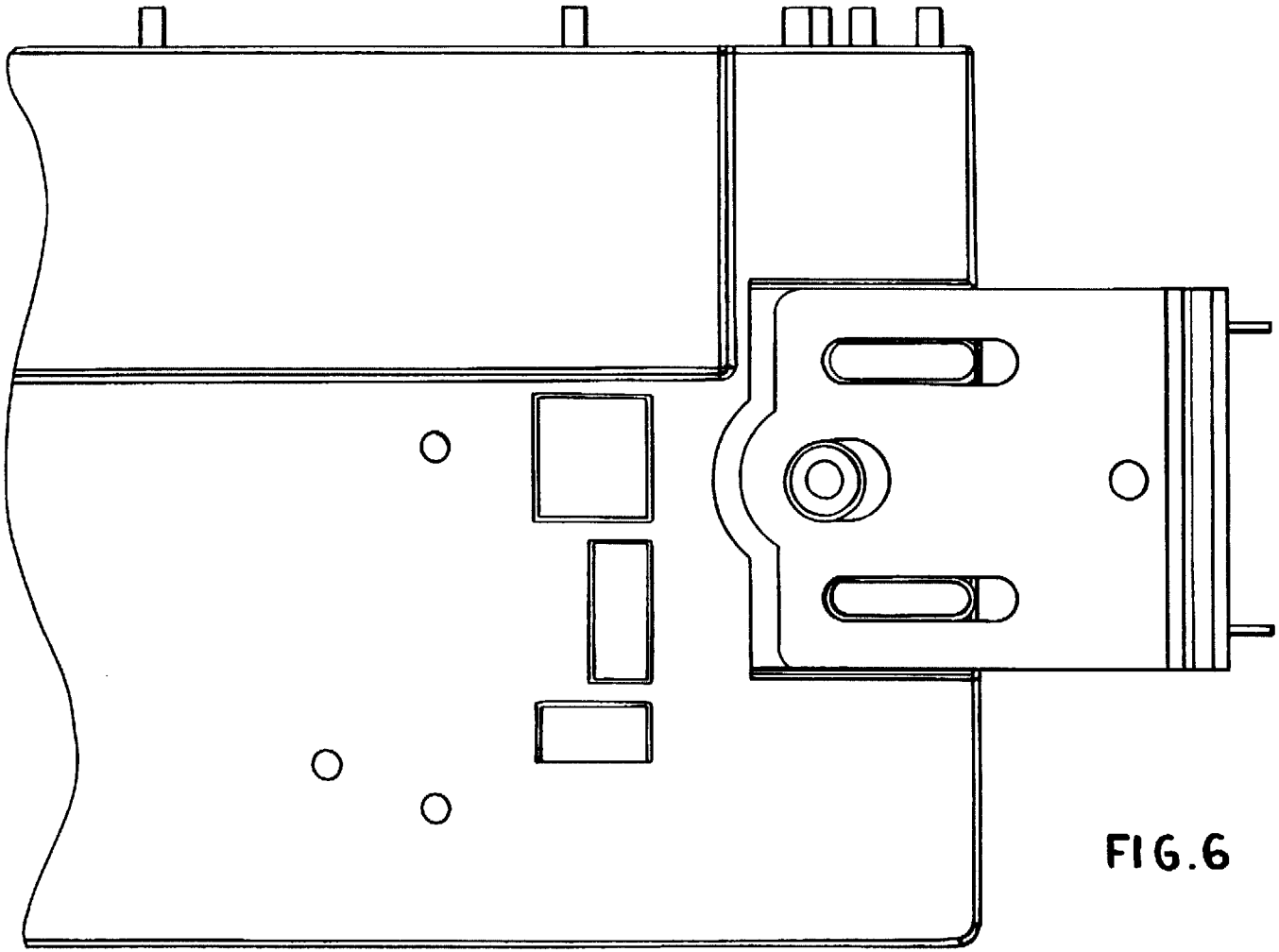
FIG. 6 is another detail of the anti-rotation bracket.
Figure 7:
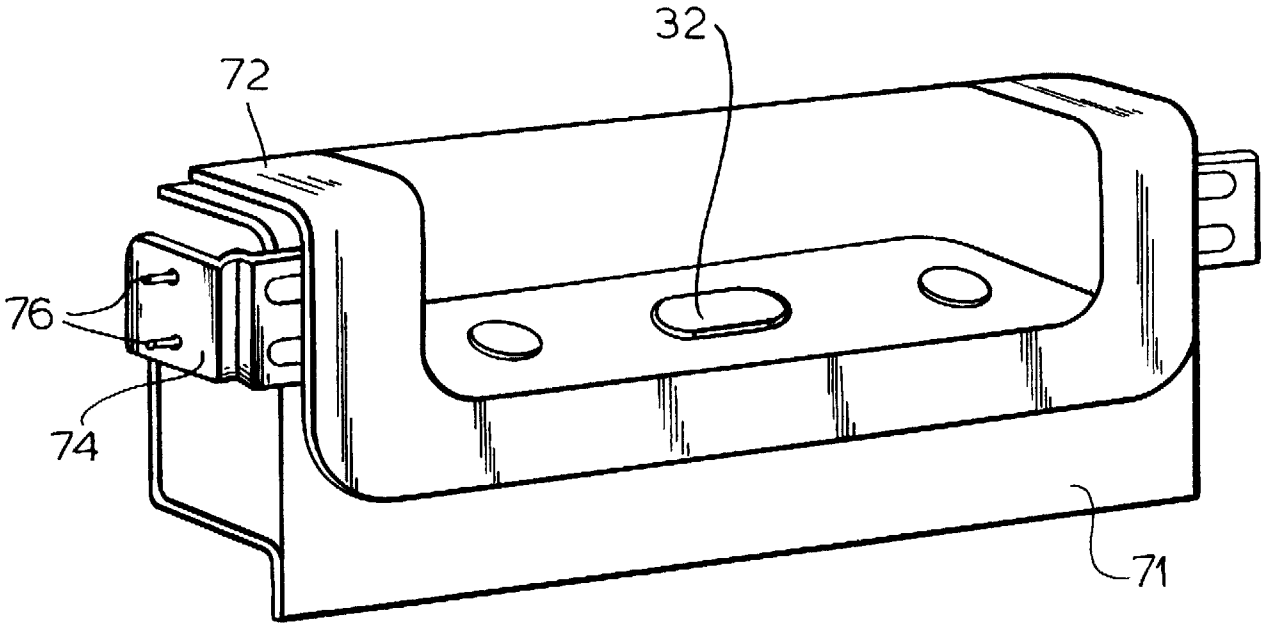
FIG. 7 is a perspective view showing the lock housing and the outer plate, but with the fabric of the suitcase removed.

Referring to FIGS. 1, 5 and 7, it can be seen that the button 32 depresses a slide 78 guided on pins 79 against the force of tension springs 78' acting on this slide and not shown, to entrain the rotary levers 80 about their respective fulcrum pivots 81 and thereby withdraw handle slides 82 and the pins 83 carried thereby from recesses in the tubular shanks 25 to release the latter and enable it to be withdrawn from the case into its extended position.

The direction of displacement of the button 32 is thus transformed first into an arcuate movement of the respective rotary lever 80 and then with a rotary movement is converted into a horizontal linear movement of the detent pin 83 retaining the handle against undesired movement in the case.

Figure 8:
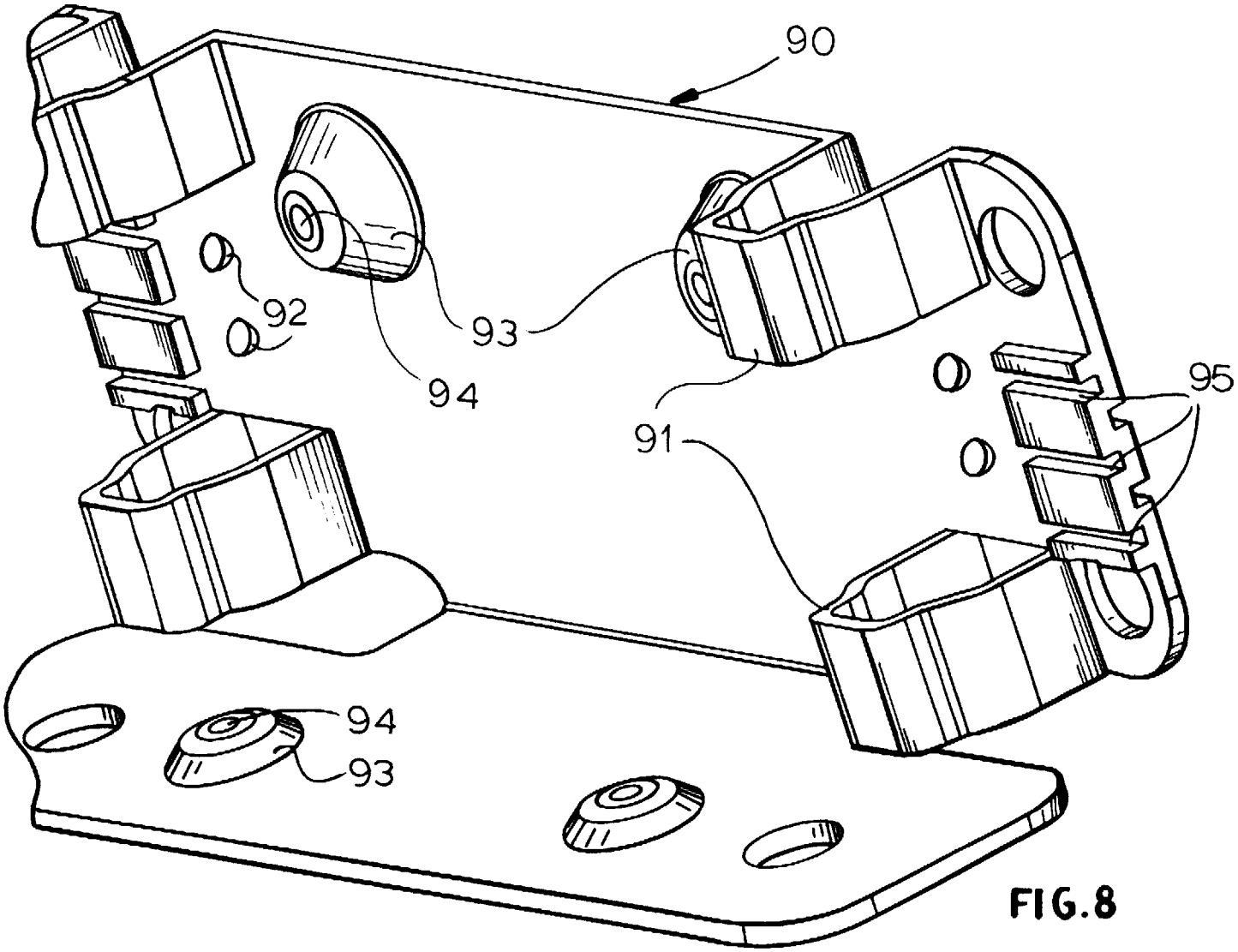
FIG. 8 is a perspective view showing an alternative bottom member with engagement protrusions for engaging the guide tubes.
Figure 9:
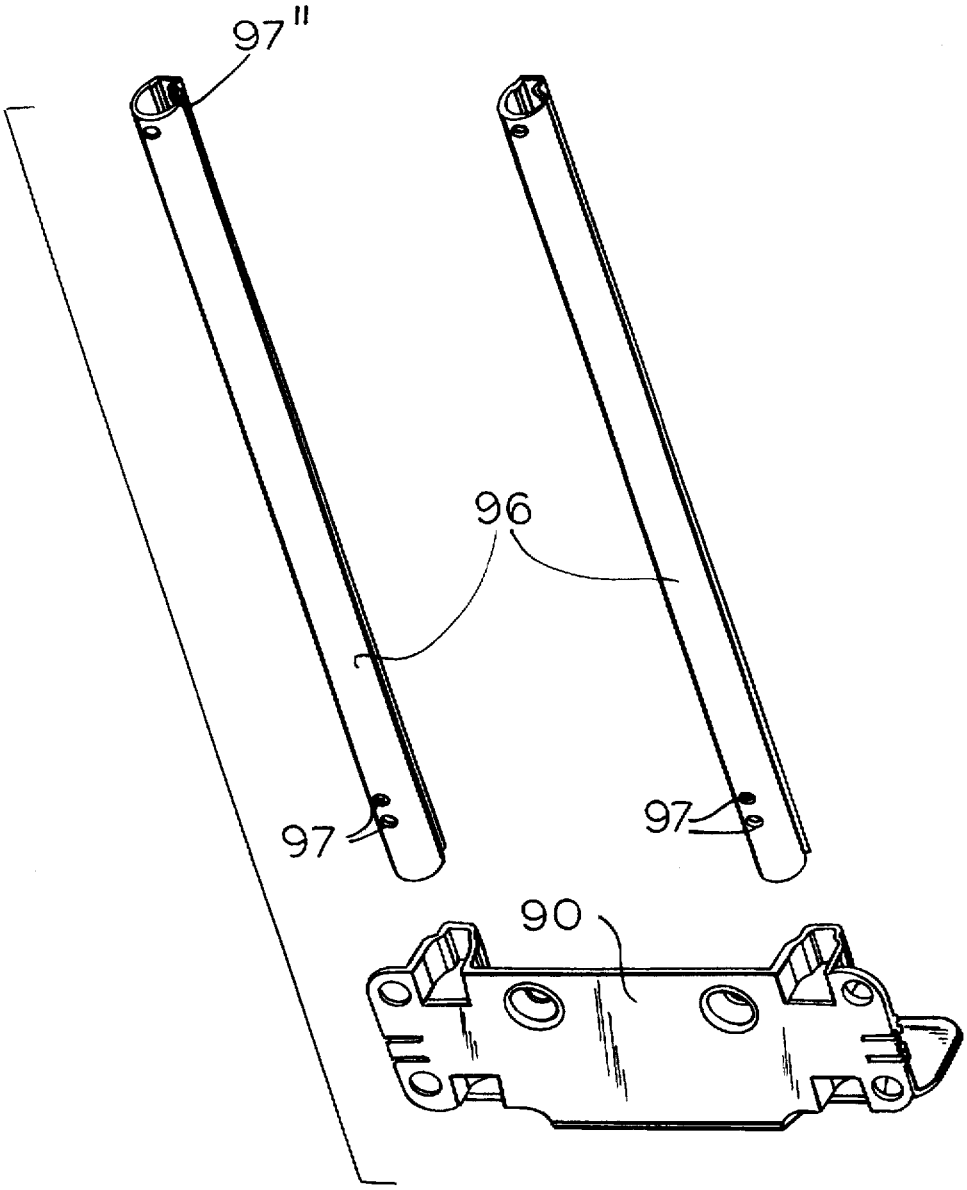
FIG. 9 shows the assembly of the guide tubes to this bottom member.
Figure 10:
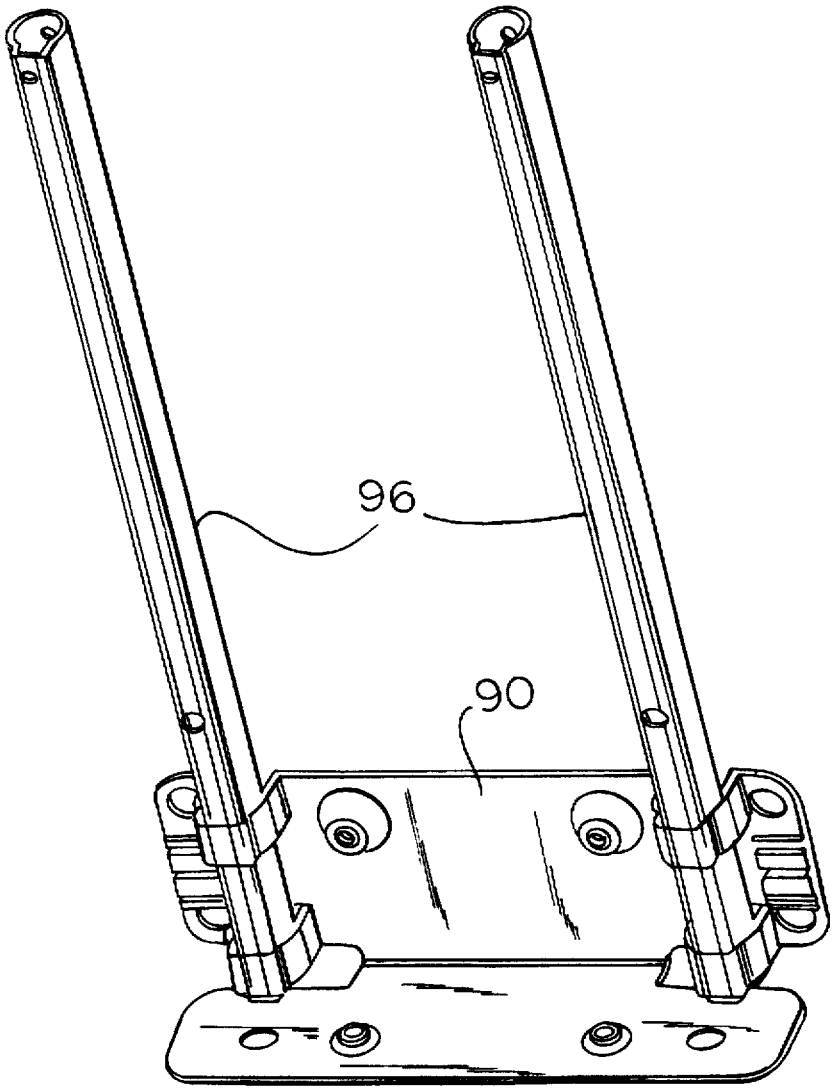
FIG. 10 shows the guide tubes locked in place in the bottom member.

While the embodiment of FIGS. 1–7 operates with cylindrical guide tubes as shown at 85 in the FIG. 3, and formed with upper holes 97" (FIG. 9) identical to lower holes 97 receiving a detent means forming respective tongues 97' upon insertion of the tubes into the housing 71; which guide tubes extend downwardly into channels 41. The central member 90 shown in FIGS. 8–10 and which is connected through the fabric of the back and bottom to an outer member similar to that shown at 31, utilizes a pair of integrally-molded straps 91 straddling a pair of frustoconical engagement protrusions 92 also molded unitarily on the member 90. The latter may have bosses 93 with bores 94 for adjustment screws, and grooves 95 engageable by ribs of the inner wheel well members in the manner previously described.

The tubes 96 here are provided with holes 97 adapted to receive the protrusions 92 when these tubes are thrust into the straps 91 so that the protrusions can secure the tubes 96 in place. This is facilitated by the inclined or conical surfaces of the protrusions. The result is a snap-in-place guide tube assembly which greatly facilitates the overall assembly process.

It will be apparent, therefore, that the interior piece 40 acts as a combination frame support, side brace and wheel housing support in the vertical handle case system and is designed to be reduced in size to fit the case size. The tongue-and-groove connections 54, 55 allow the interior wheel housings to lock into the brace 40 with a slide action permitting adjustment for variants in bag sewing. The interior parts 47, 40 upon assembling extend along a continuous fictional axle to keep the wheel axes in line and the ribbing prevents bowing of the case.

The member 40 can hold two ends of a frame whose ends meet at the bottom together without an additional piece and each exterior wheel housing is secured to the interior housing at three mutually perpendicular planes. The rotator mechanism described reduces the friction which might otherwise be generated by an inclined plane cam mechanism and the guide tube can snap in place as has been mentioned. The slide 78 and the levers 80 can be held in place by the cover which has been removed to reveal the mechanism in FIG. 5.

We claim:

1. An extendable-handle rolling luggage article comprising:

a generally rectangular parallelepipedal case having a back wall, a front wall, a pair of side walls, a top wall and a bottom wall;

a frame internally of said case extending along said top, bottom and side walls;

a handle mechanism affixed to said case and comprising a housing disposed at said top wall, a handle assembly in said housing and including a handle and a pair of shanks, and handle means for displacing said assembly upwardly in an extended position thereof from said housing to enable said article to be drawn along a floor; and mounting means along said bottom wall formed with wheel wells for receiving respective wheels adapted to roll on said floor, said mounting means including:

a molded plastic L-section support internally of said case extending along said back wall and said bottom wall, secured to said back wall and to said frame along said bottom wall, and of a length selected to match a width of said article, said support being provided with formations facilitating severing of segments from said support to match the support to a selected width of the article to be fabricated, said segments and a body of said support inwardly of said segments being formed with oval openings through which said support is secured to said case, a respective end portion internally of said case secured to said support at a respective end thereof through said oval openings and formed with one of said wheel wells at a respective bottom back corner of said case, and a respective outer member externally of said case fastened to each of said end portions through said case.

2. The article defined in claim 1 wherein each of said end portions and the respective outer member are secured together by fasteners connecting them at three mutually perpendicular planes.

3. The article defined in claim 1 wherein said support is formed with ribs extending parallel to a back bottom edge of said case and limiting bowing of the support.

4. The article defined in claim 3 wherein said end portions are recessed to receive said ribs.

5. The article defined in claim 1 wherein said support is formed with a back flange lying along and secured to said back wall, said back flange being formed with oval openings elongated in a direction perpendicular to a back bottom edge of the case for enabling adjustment of the support relative to the case.

6. The article defined in claim 1 wherein said support is formed with a bottom flange lying along and secured to said bottom wall, said frame extending continuously around said bottom, side and top walls from one frame end at said bottom wall to another frame end adjoining said one frame end at said bottom wall, said bottom flange being secured directly to both frame ends to prevent downward deflection thereof.

7. The article defined in claim 1, further comprising a pair of tubes in said case bridging said housing and said support and receiving said shanks.

8. The article defined in claim 7, further comprising detent means automatically locking said tubes in said housing upon insertion of said tubes into said housing.

9. The article defined in claim 8 wherein said housing has a cover and said detent means includes a finger on said cover engaging in a hole in the respective tube.

10. The article defined in claim 1, further comprising a lock means in said housing for releasably retaining said assembly in said extended position and a retracted position of said assembly.

11. The article defined in claim 10 wherein said means comprises:

a spring-biased slide mounted in said housing and provided with a button actuatable from an exterior of the housing, a pair of rotary levers in said housing pivotally connected to said slide, a respective pin carriage in said housing displaceable perpendicular to each of said shanks and pivotably connected to each of said levers, and a respective locking pin engageable in each of said shanks and carried by the respective pin carriage.

* * * * *